US011718445B2

(12) United States Patent
Paruchuri

(10) Patent No.: US 11,718,445 B2
(45) Date of Patent: Aug. 8, 2023

(54) PACKING DEVICE FOR PRODUCTS

(71) Applicant: Pragati Pack (India) Pvt. Ltd., Telangana (IN)

(72) Inventor: Hemanth Paruchuri, Telangana (IN)

(73) Assignee: Pragati Pack (India) Pvt. Ltd., Telangana (IN)

( * ) Notice: Subject to any disclaimer, the term of this patent is extended or adjusted under 35 U.S.C. 154(b) by 0 days.

(21) Appl. No.: 17/381,392

(22) Filed: Jul. 21, 2021

(65) Prior Publication Data

US 2022/0024636 A1 Jan. 27, 2022

(30) Foreign Application Priority Data

Jul. 21, 2020 (IN) ..... 202041031109

(51) Int. Cl.
*B65D 5/50* (2006.01)
*B65D 5/52* (2006.01)

(52) U.S. Cl.
CPC ..... *B65D 5/5038* (2013.01)

(58) Field of Classification Search
CPC .... B65D 25/10; B65D 25/103; B65D 25/102; B65D 25/105; B65D 85/305; Y10T 403/599; Y10T 70/5075; F16B 2/20
USPC ..... 206/433, 139, 427, 562
See application file for complete search history.

(56) References Cited

U.S. PATENT DOCUMENTS

| | | | | | |
|---|---|---|---|---|---|
| 47,430 | A * | 4/1865 | Kolb | B65D 5/5213 | 206/754 |
| 898,007 | A * | 9/1908 | Rowe | B65D 25/105 | 211/14 |
| 1,867,455 | A * | 7/1932 | Humphrey | B65D 25/105 | 190/110 |

FOREIGN PATENT DOCUMENTS

| | | | | |
|---|---|---|---|---|
| EP | 0727367 | A1 * | 2/1996 | B67C 3/24 |
| EP | 790063 | A1 * | 8/1997 | A61M 5/002 |
| FR | 2600307 | * | 12/1987 | B65D 5/5021 |
| FR | 2600307 | A1 * | 12/1987 | B65D 5/5021 |
| GB | 283331 | A * | 12/1926 | B65D 5/5213 |
| GB | 283331 | * | 1/1928 | B65D 5/5213 |

* cited by examiner

*Primary Examiner* — Anthony D Stashick
*Assistant Examiner* — Marcos Javier Rodriguez Molina
(74) *Attorney, Agent, or Firm* — BakerHostetler; Tayan B. Patel

(57) ABSTRACT

A packaging device comprises a bod, a neck receiver, and a holder. The box is cuboidal in shape with multiple openings to accommodate a container. The neck receiver is positioned within the box to receive a neck portion of the container. The holder is inserted within the neck receiver to mount an elastic band, wherein the neck receiver is pulled out and pulled into position within a channel defined on the box using the elastic band. In an embodiment, the container is a bottle, where the neck receiver receives the neck portion of the bottle at a curved section of the neck receiver and an extended section of the neck receiver is designed to traverse along a channel defined on the box.

8 Claims, 3 Drawing Sheets

PACKING DEVICE FOR PRODUCTS

FIELD OF INVENTION

This invention relates to an apparatus for holding a bottle in a casing. More particularly, the present invention relates to a packing device and the mechanism associated with packaging device that holds bottles or other objects in a box and prevents them from falling off.

BACKGROUND OF THE INVENTION

Packaging of glass or ceramic bottles are generally done using materials that are extendable, or in other words, which can accommodate the body of the bottle in a snap fit position. For example, plastic is the most widely used material for designing snap-fit packaging models. The packaging is generally designed with a cavity that is designed to receive the bottle or the shape of the bottle. During operation, the bottle is pushed into the cavity to snap fit into the cavity. Since the body of the packaging is made of plastic, the sides of the cavity have elastic properties to extent and receive the body of the bottle.

However, plastic being the most widely used packaging material, is currently identified to be not environment friendly and is banned in most countries. Therefore, there is a need to come up with a material that is more environment friendly, and which can incorporate a mechanism that snap-fits to receive the body of the bottle. Hence, there is a long felt but unforeseen need for an apparatus that has a quick fit mechanism to receive the body of the bottle during packaging, where the apparatus is made of an environment friendly material.

SUMMARY OF THE INVENTION

The following presents a simplified summary of the subject matter in order to provide a basic understanding of some of the aspects of subject matter embodiments. This summary is not an extensive overview of the subject matter. It is not intended to identify key/critical elements of the embodiments or to delineate the scope of the subject matter. Its sole purpose to present some concepts of the subject matter in a simplified form as a prelude to the more detailed description that is presented later.

A packaging device addresses the need for an apparatus that has a quick fit mechanism to receive the body of the bottle during packaging, where the apparatus is made of an environment friendly material. The packaging device comprises a box a neck receiver, and a holder. The box is cuboidal in shape with multiple openings to accommodate a container. The neck receiver is positioned within the box to receive a neck portion of the container. The holder is inserted within the neck receiver to mount an elastic band, wherein the neck receiver is pulled out and pulled into position within a channel defined on the box using the elastic band. In an embodiment, the container is a bottle, where the neck receiver receives the neck portion of the bottle at a curved section of the neck receiver and an extended section of the neck receiver is designed to traverse along a channel defined on the box.

In an embodiment, the elastic band is hinged at a hinging section defined on the box and extends around the holder in response to receiving the neck portion of the bottle. The holder is positioned inside the neck receiver to contact the elastic band, where the elastic band creates tension to pull the neck receiver along the channel when a force is applied on the curved section of the neck receiver using the neck portion of the bottle. During operation using the packaging device, initially the bottle is placed inside the curved section of the neck receiver within the box, wherein the neck receiver and the elastic band holds the bottle near the neck portion. When the bottle is inserted in the neck receiver, the neck receiver moves to the right to allow the neck portion of the bottle to fall and fit into the curved section on the neck receiver.

In an embodiment, the elongate band is hinged at the hinging section and pulls the neck receiver leftward so that the neck portion of the bottle is always pulled towards the left side, and the neck receiver slides leftward along the channel. When the bottle is positioned on the neck receiver towards the left side along the channel, the elastic band pulls the neck receiver to the left and the bottle is secured in a tight position. The bottle is removable by holding the bottle at the neck portion by inserting the fingers in slots that are provided on surface of the box.

In other words, the packaging device uses a mechanism that holds in place bottles or other objects in the box and prevents them from falling out. The mechanism is made with two pieces of paperboard. One piece is fixed and the other piece slides in the confines of the fixed piece. Both the pieces are connected with elastic which helps in holding the bottle in place. The contours of the movable/sliding piece is made such that the bottle pushes aside the piece while being inserted.

Once the bottle is inserted, the contour ensures that the bottle is held tightly. The bottle can be removed by pulling the bottle from the provided finger gap.

BRIEF DESCRIPTION OF THE ACCOMPANYING DRAWINGS

The following drawings are illustrative of particular examples for enabling systems and methods of the present disclosure, are descriptive of some of the methods and mechanism, and are not intended to limit the scope of the invention. The drawings are not to scale (unless so stated) and are intended for use in conjunction with the explanations in the following detailed description.

Figure 1A:
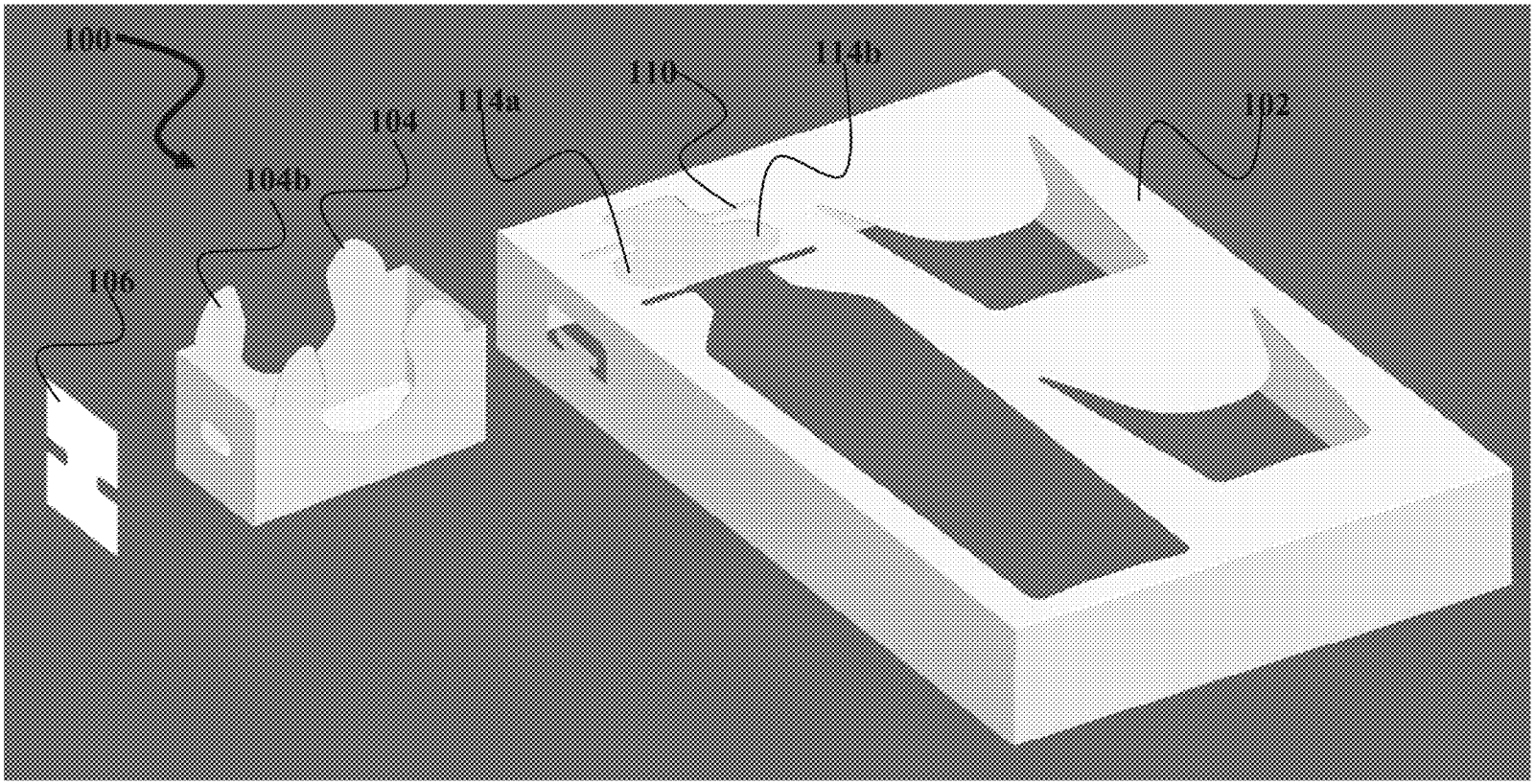
FIG. 1A is an exploded view of the packaging device in accordance to an embodiment of the present invention.

Persons skilled in the art will appreciate that elements in the figures are illustrated for simplicity and clarity and may represent both hardware components of the system. Further, the dimensions of some of the elements in the figure may be exaggerated relative to other elements to help to improve understanding of various exemplary embodiments of the present disclosure. Throughout the drawings, it should be noted that like reference numbers are used to depict the same or similar elements, features, and structures.

DETAILED DESCRIPTION

Exemplary embodiments now will be described. The disclosure may, however, be embodied in many different forms and should not be construed as limited to the embodiments set forth herein; rather, these embodiments are provided so that this disclosure will be thorough and complete, and will fully convey its scope to those skilled in the art. The terminology used in the detailed description of the particular exemplary embodiments illustrated in the accompanying drawings is not intended to be limiting. In the drawings, like numbers refer to like elements.

It is to be noted, however, that the reference numerals used herein illustrate only typical embodiments of the present subject matter, and are therefore, not to be considered for limiting of its scope, for the subject matter may admit to other equally effective embodiments.

The specification may refer to "an", "one" or "some" embodiment(s) in several locations. This does not necessarily imply that each such reference is to the same embodiment(s), or that the feature only applies to a single embodiment. Single features of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include operatively connected or coupled. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The packaging device 100 disclosed here is primarily designed to enable the usage of multiple varieties of paperboard-based holding mechanisms for bottles/products, where currently the material used is plastic such as Hi-Impact Polystyrene, PET, etc., which are not environment friendly. Since a paperboard-based holding mechanism is used in the packing device 100, a mechanism to establish a snap fit reception of the bottle body regardless of the non-elastic property of the paperboard is disclosed in the below description.

Figure 1B:
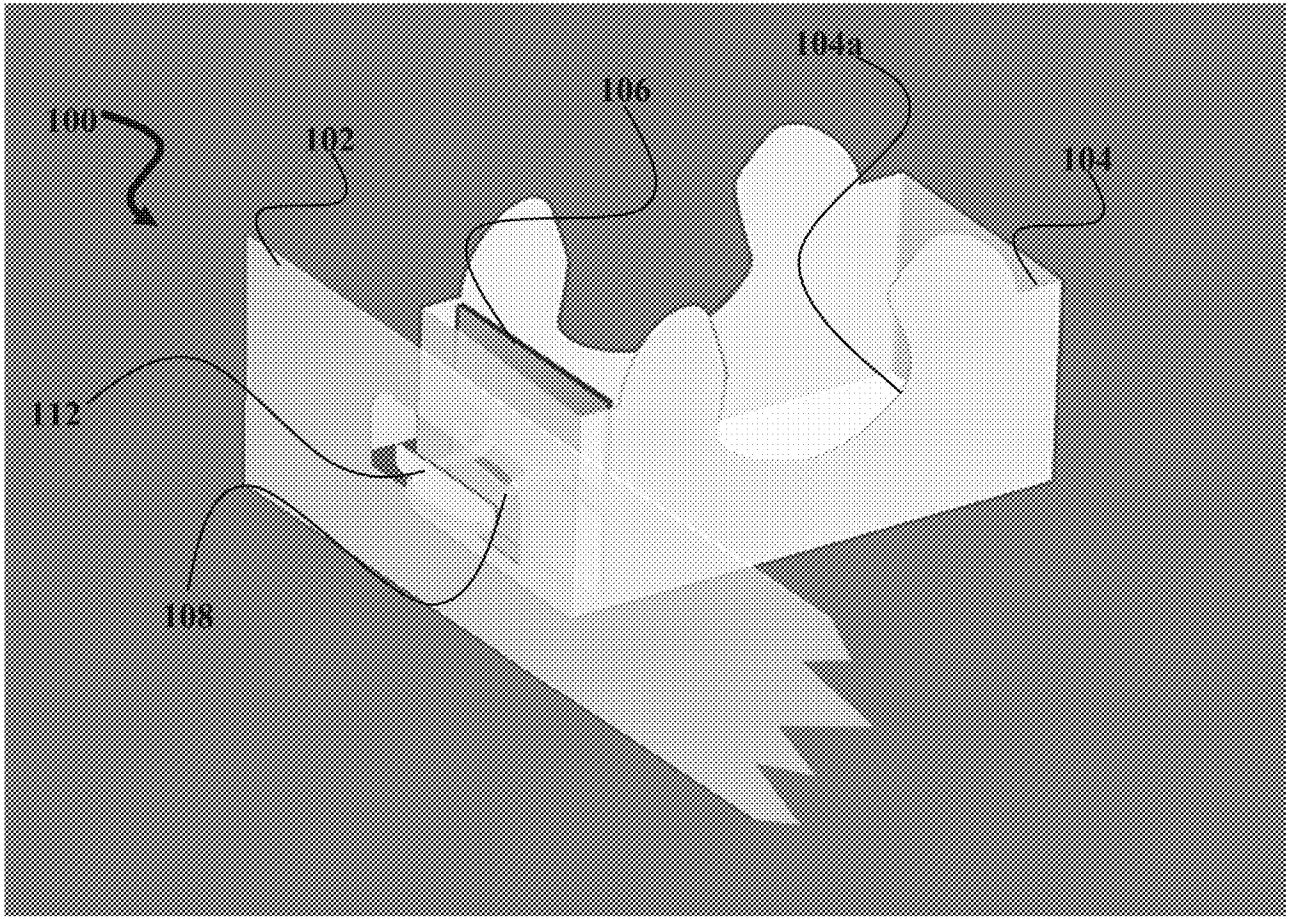
FIG. 1B shows a section of an assembled view of the packaging device in accordance to the embodiment of the present invention.
Figure 1C:
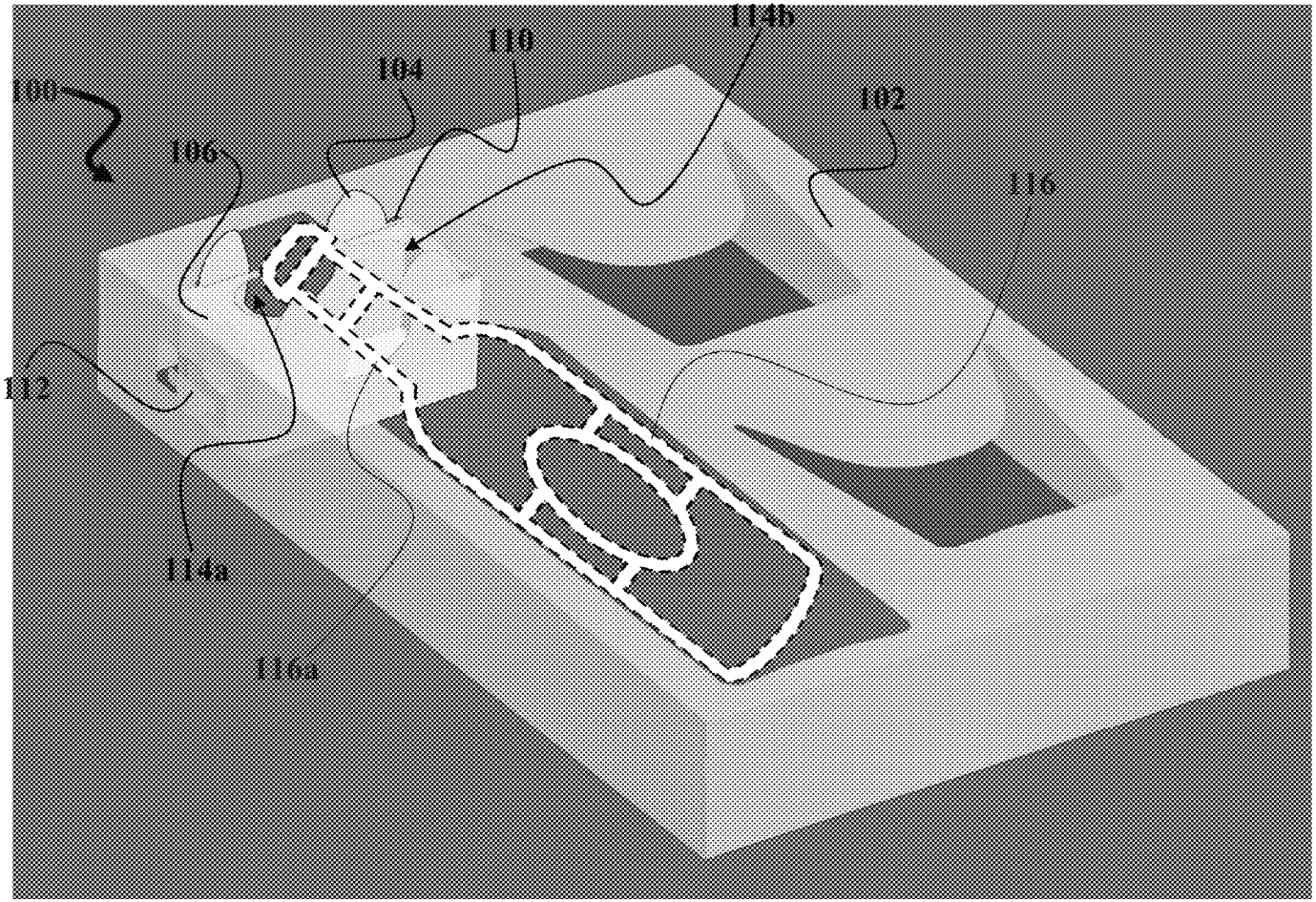
FIG. 1C shows an assembled view of the packaging device in accordance to the embodiment of the present invention.

FIGS. 1A-1C show an exploded view, a section of an assembled view, and the assembled view respectively, of the packaging device 100 in accordance with an embodiment of the present invention. The packaging device 100 comprises a box 102, a neck receiver 104, and a holder 106 for an elastic band, for example, a rubber band 108, where the holder 106 is inserted within the neck receiver 104. The exploded view showing the above-mentioned components individually is shown in FIG. 1A, where the box 102 is generally cuboidal in shape with multiple openings to accommodate a container, for example, a bottle 116 as well as other items that are similar in dimensions to a bottle 116. The neck receiver 104 is an element designed to receive the neck portion 116*a* of the bottle 116 at the curved section 104*a* (as shown in FIG. 1B) and extended sections 104*b* of the neck receiver 104 is designed to traverse along a channel 110. The neck receiver 104 is designed to be pulled out and pulled into position within the channel 110 using the rubber band 108. The rubber band 108 is hinged at a hinging section 112 defined on the box 102, and is designed to extend around the holder 106 in response to receiving the neck portion 116*a* of the bottle 116. The holder 106 is positioned inside the neck receiver 104 to contact the rubber band 108. The rubber band 108 creates tension to pull the neck receiver 104 along the channel 110 when a force is applied on the curved section 104*a* of the neck receiver 104 using the neck portion 116*a* of the bottle 116.

During operation using the packaging device 100, initially the product/bottle 116 is placed inside the curved section 104*a* of the neck receiver 104 within the box 102. The locking mechanism that includes the neck receiver 104 and the rubber band 108 are designed to hold the bottle 116 near the neck portion 116*a*. When the bottle 116 is inserted in the neck receiver 104, the neck receiver 104 moves to the right allowing the neck portion 116*a* of the bottle 116 to fall and fit into the curved section 104*a* provided on the neck receiver 104. The rubber band 108 is hinged at a hinging section 112 and pulls the neck receiver 104 leftward to ensure that the neck portion 116*a* of the bottle 116 is always pulled towards the left side, where the neck receiver 104 slides leftward along the channel 110. Once the bottle 116 is in placed on the neck receiver 104 leftward along the channel 110, the rubber band 108 pulls the neck receiver 104 to the left and the bottle 116 is secured in a tight position. The bottle 116 can be removed by holding the bottle 116 at its neck portion 116*a* by inserting the fingers in the slots 114*a* and 114*b* (as shown in FIGS. 1A and 1C) that are provided on the surface of the box 102.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore, contemplated that such modifications can be made without departing from the spirit or scope of the present invention as defined.

I claim:

1. A packaging device comprising:

a box that is cuboidal in shape with a top side, bottom side, left side, right side, and an opening to accommodate a container, wherein the container is packed within the box;

a neck receiver positioned within the opening of the box, wherein the neck receiver is configured to be displaced sideways in relation to a longitudinal axis of the box extending between the top side and the bottom side of the box, wherein the neck receiver is configured to receive a neck portion of the container, and wherein the neck portion is an end section of the container; and a holder inserted within the neck receiver, wherein the holder is configured to mount an elastic band, wherein the elastic band is configured to pull the neck receiver, wherein the elastic band is looped over a hinging section causing the neck receiver to be pulled towards the left side of the box and causing the neck portion of the container to always be pulled towards the left side of the box, wherein the neck receiver slides leftward towards the left side of the box along a channel defined on the box, and wherein the neck receiver is configured to be pulled out and pulled into position within the channel using the elastic band.

2. The packaging device as claimed in claim 1, wherein the container that is packed within the box is a bottle or a vessel.

3. The packaging device as claimed in claim 1, wherein the neck receiver is configured to receive the neck portion of the container at a curved section of the neck receiver, and an extended section of the neck receiver is designed to traverse along the channel defined on the box, wherein the channel is an opening in a surface of the box that permits the sideways displacement of the neck receiver.

4. The packaging device as claimed in claim 1, wherein the elastic band is hinged at a hinging section defined on the box and extends around the holder in response to receiving the neck portion of the container, the elastic band extends due to an elongation of the elastic band due to the sideways displacement of the neck receiver, and the elastic band loops over the hinging section.

5. The packaging device as claimed in claim 1, wherein the holder is positioned inside the neck receiver and configured to contact the elastic band, the neck receiver contacts the elastic band by looping around the elastic band in the holder, the elastic band is configured to loop around the holder, the elastic band is configured to create tension to pull the neck receiver along the channel when a force is applied on a curved section of the neck receiver using the neck portion of the container, and a vertical force translated upon the neck portion generates a horizontal force in a direction towards the right side of the box that imposes tension in the elastic band.

6. The packaging device as claimed in claim 1, wherein during operation using of the packaging device, the container is configured to initially be placed inside a curved section of the neck receiver within the box, the neck receiver and the elastic band are configured to hold the container near the neck portion, and wherein the neck receiver is configured to move to rightward to allow the neck portion of the container to fall and fit into a curved section on the neck receiver.

7. The packaging device as claimed in claim 1, wherein when the container is positioned on the neck receiver towards the left side along the channel, the elastic band is configured to pull the neck receiver leftward and the container is tightly secured, and wherein the container is tightly secured due to a latching effect caused by the neck receiver when inserting the container in a curved section of the neck receiver.

8. The packaging device as claimed in claim 7, wherein the container is removable by manually holding the neck portion, sliding to a right direction of the neck receiver, and pulling the neck portion out of the packaging device.

* * * * *